US009156073B2

(12) United States Patent
Wang et al.

(10) Patent No.: US 9,156,073 B2
(45) Date of Patent: Oct. 13, 2015

(54) FORMING APPARATUS, SHOE THEREOF AND FORMING METHOD

(75) Inventors: Feizhou Wang, Osaka (JP); Tomoyasu Nakano, Osaka (JP); Akinori Inokuma, Osaka (JP); Jilong Yin, Osaka (JP); Terutomo Akai, Osaka (JP)

(73) Assignee: NAKATA MANUFACTURING CO., LTD., Osaka (JP)

( * ) Notice: Subject to any disclaimer, the term of this patent is extended or adjusted under 35 U.S.C. 154(b) by 749 days.

(21) Appl. No.: 12/921,067

(22) PCT Filed: Feb. 26, 2009

(86) PCT No.: PCT/JP2009/053563

§ 371 (c)(1), (2), (4) Date: Sep. 3, 2010

(87) PCT Pub. No.: WO2009/110372

PCT Pub. Date: Sep. 11, 2009

(65) Prior Publication Data

US 2011/0023571 A1 Feb. 3, 2011

(30) Foreign Application Priority Data

Mar. 3, 2008 (JP) ..... 2008-052571

(51) Int. Cl.
*B21C 37/08* (2006.01)
*B21C 37/083* (2006.01)
*B21D 5/10* (2006.01)

(52) U.S. Cl.
CPC ..... *B21C 37/08* (2013.01); *B21C 37/083* (2013.01); *B21D 5/10* (2013.01)

(58) Field of Classification Search
CPC ..... B21D 5/10; B21D 7/10; B21D 43/12; B21D 43/145; B21C 37/08; B21C 37/083
USPC ..... 72/127, 133, 166, 169, 176, 178, 250, 72/252, 419, 422, 428; 100/118, 151, 152, 100/212, 306, 307
See application file for complete search history.

(56) References Cited

U.S. PATENT DOCUMENTS

| | | | | |
|---|---|---|---|---|
| 1,980,308 | A * | 11/1934 | Adams, Jr. | 72/176 |
| 2,569,266 | A * | 9/1951 | Thompson | 72/166 |
| 3,606,780 | A * | 9/1971 | Kichisaburo | 72/77 |
| 4,824,354 | A * | 4/1989 | Keaton | 100/151 |
| 4,994,138 | A * | 2/1991 | Prihoda | 100/151 |
| 8,161,786 | B2 * | 4/2012 | Stapleton | 72/428 |

FOREIGN PATENT DOCUMENTS

| | | |
|---|---|---|
| GB | 350599 | 6/1931 |
| JP | 55-51648 | 12/1980 |

(Continued)

OTHER PUBLICATIONS

International Search Report issued in International Application No. PCT/JP2009/053563, mailed Mar. 24, 2009 —4 pages.

*Primary Examiner* — Teresa M Eikert
(74) *Attorney, Agent, or Firm* — Hamre, Schumann, Mueller & Larson, P.C.

(57) ABSTRACT

A forming apparatus and method for forming a sectional profile of round tubing, angled tubing or open forming stock without losing the manufacturability of conventional roll forming The forming apparatus comprises individual shoe blocks having a pass on their rotating curved faces. The shoe blocks can be moved in the circumferential direction on an endless track, and are connected to provide the same curvature radius and length as a required arc segment of a virtual large-diameter circle.

15 Claims, 11 Drawing Sheets

(56) References Cited

FOREIGN PATENT DOCUMENTS

| | | |
|---|---|---|
| JP | 6-49760 | 2/1994 |
| JP | 8-18075 | 2/1996 |
| JP | 8-187516 | 7/1996 |
| JP | 2000-167620 | 6/2000 |
| JP | 2002-529252 | 9/2002 |
| WO | 00/29164 | 5/2000 |

* cited by examiner

FORMING APPARATUS, SHOE THEREOF AND FORMING METHOD

TECHNICAL FIELD

Relating to a new apparatus and a method for forming an opening section member having various kinds of sectional shapes, such as a round pipe or a rectangular pipe, from a metal coil or a strip material with a prescribed length, this invention is a forming apparatus, a shoe thereof and a forming method using a turning unit in which a shoe-blocks train formed by using the plural shoes of which forming dies provided outward surface and moves on an endless track to realize a forming operation just like that obtained by using forming rolls having a huge diameter.

BACKGROUND ART

In general, as a continuous manufacturing process of long metal products, forming rolls are ordinarily used. A typical process among them represented by an electric-resistance-welded pipe process ordinarily includes a pre-process for rewinding a metal coil as a material to supply the metal coil to a forming process, an initial forming process carried out by break down rolls, cluster rolls and fin pass rolls, a welding process for welding opposed edge parts of a strip material by, for instance, a high frequency welding, a sizing process for correcting the roundness and the straightness of the pipe by correction rolls and a cutting process for cutting the manufactured metal pipe to a prescribed length.

A forming method of the long metal products generally classified the above-described roll forming method and a press forming method. In the press forming, a material to be formed basically receives only a two-dimensional deformation in a section, so that the material to be formed has less excessive distortion and residual stress, and a dimensional accuracy of the product is easily obtained. However, an investment for plants and equipments including a metal die is high, productivity is low and the length of the product is restricted. On the other hand, in the roll forming, since not only the investment for plants and equipments is low, but also a continuous production can be realized, the productivity is also high. Further, the length of the product is scarcely restricted. However, since the material to be formed receives three-dimensional deformation depending on forming rolls, below-described disadvantages arise.

Most of fundamental problems in the roll forming reside in that a forming tool is rolls as a rotating member and a radius of rotation thereof cannot be made very large due to the restriction of a production capacity, a cost or the like. Therefore, specifically, problems as stated below arise.

(1) A feature of the three-dimensional deformation such as a winding of the material round the rolls is strong. Not only a deformation in a section as an object of forming, but also various additional deformations and distortion in other directions are generated. As a result, a total distortion is large and a state of the residual stress is complicated, which gives a bad influence to the dimensional accuracy and an intrinsic quality of the product.

(2) Since a peripheral speed difference in a contact area between the rolls and the material to be formed is large, a problem frequently arises in view of the surface quality of the product due to a relative slip between both the rolls and the material to be formed.

(3) Since the contact area between the rolls and the material to be formed is small in comparison with a severe deformation, a surface pressure between the rolls and the material be formed is high. As a combined effect of the high surface pressure and the peripheral speed difference, the wearing of the rolls is serious and a cost for maintaining the dimensional accuracy of the product becomes high.

(4) As an insertion resistance which the material to be formed receives from the roll is large, It is frequently caused insufficient thrust force, and necessary driving energy becomes high.

For instance, in the sizing process of the above-mentioned continuous manufacturing process of the metal pipe, two-way rolls stand, three-way rolls stand or four-way rolls stand is used which is arranged on the same plane in which central axes are vertical to an axis of the pipe. In any of combinations of these rolls, such a pass is formed as to hold substantially all the periphery of an outer surface of a material pipe.

As a structure that obtains a high reduction ratio per one pass for the purpose of reducing the number of forming roll stands in the sizing section, a method is proposed that outside diameters of the opposed right and left rolls of the four-way rolls stand are made to be smaller than outside diameters of the opposed top and bottom rolls, and the opposed right and left rolls are arranged at positions more upstream than positions of the opposed top and bottom rolls (PTL 1).

Patent Literature

[PTL 1] JP-A-2000-167620
[PTL 2] JP-A-08-187516
[PTL 3] JP-B-08-018075
[PTL 4] JP-T-2002-529252 (WO00/29164)

DISCLOSURE OF INVENTION

Issues to be Solved by Invention

When the electric-resistance-welded pipe is manufactured, after the initial forming process is carried out by the break down rolls, the cluster rolls and the fin pass rolls, squeezing is applied to the material pipe by the opposed rolls of the two-way rolls stand or the four-way rolls stand in the sizing process in order to obtain the product with high dimensional accuracy. However, not only bending and squeezing within the section as an object of forming, but also various additional deformations and distortions in other directions are generated and accumulated due to the characteristics of the rolls as the forming tool as described above, which frequently gives a serious influence to a forming of the cross section.

Accordingly, for instance, in the above-mentioned sizing process, an elastic recovery deformation in the section of the product becomes extremely complicated. Thus, the above-described problems peculiar to the forming rolls cannot be solved, for instance, a desired dimensional accuracy of the product is not easily obtained.

It is an object of the present invention to provide a new forming apparatus, a forming tool thereof and a forming method in which in any of forming processes for a round pipe, a rectangular pipe and an opening section material, the productivity of a usual roll forming is not deteriorated and a prescribed forming operation is carried out with less additional deformation and distortions applied to a material to be formed so that a product with a high dimensional accuracy and a high quality may be manufactured.

Countermeasures to the Issues

When the inventor et al. analyze the distribution of a stress which the material to be formed undergoes during the roll forming to investigate the above-described problems of the forming rolls, they recognize that only an exceedingly limited surface in the vicinity of a part (a cross-section of a material including the axis of the rolls) immediately below the rolls come into contact with the material to be formed, and an extremely strong load is locally applied under a state similar to a point contact or a linear contact.

The inventor et al. recognize that, for instance, when a stress distribution is displayed for such an analysis, a peak of an extremely strong contact stress is generated in a certain part just before the part immediately below the rolls, and think that a new forming apparatus and a forming method need to be developed in which a uniform force acts on a wide range coming into contact with the material to be formed without generating the peak of such stress.

For instance, in the press forming in which the simple two-dimensional deformation of the material is obtained, a continuous forming operation which is an advantage in the roll forming cannot be realized. Alternatively, in a draw-forming method by a metal die, the occurrence of flaws on the surface of the product and a serious abrasion of the metal die are unavoidable and the same productivity as that of the roll forming cannot be absolutely obtained.

Thus, as disclosed in PTL 2, a device is supposed to be used in which a belt is used together with rolls or shoes to prevent flaws and apply a driving force. However, since the low-rigidity belt is interposed, the device is suitable for a material whose thickness is small, however, such a high forming capability as that of an ordinary roll forming cannot be obtained.

Further, as disclosed in PTL 3 and PTL 4, a device may be supposed to be provided in which many shoes having prescribed passes are connected together in the form of a chain and the shoes are configured as an endless forming shoe group rotating on an oval or elliptical endless track. In this device, since butting surfaces of both ends of a strip material are welded, the device is suitable for the purpose of properly holding a material pipe that is already formed in a cylindrical form in a pre-process, however, the device is not suitable for various and diverse forming processes or the above-described sizing process as in the roll forming.

The inventor et al. further study the usual roll forming method or the press forming method for the purpose of providing a new forming apparatus and a forming method capable of solving the problems of the roll. Consequently, when they simulate cases that, for instance, in the sizing process, forming rolls are used which have diameters several ten times, several hundred times and several thousand times as large as the diameter of a target pipe, they notice that saturation points of effects exist under various conditions such as a dimension of a material to be formed, however, the above-described peak of the local contact stress by the usual forming roll can be greatly moderated.

However, since it is unrealistic to manufacture the forming roll having the above-described huge diameter, the inventor et al. attempt to realize a compact forming apparatus by which the same effects as those obtained by using the forming roll having the huge diameter can be obtained. They pay attention to a fact that even in the huge forming roll, only an extremely limited part comes into contact with the material to be formed and study a structure which can realize the huge forming roll.

As a result, the inventor et al. obtain a knowledge that the forming apparatus can be made in which a shoe block train is used that is formed by connecting together with many shoes each having die with circular curved surface so as to be continuously movable on an endless track with the pass directed outward. And the same radius of curvature and the same circular arc length as those of a prescribed circular arc part of a virtual circle having a diameter of an assumed huge forming roll are given to a surface of the endless track in a forming block which abuts on and moves synchronously with the material to be formed, so that the shoe block train passing the endless track surface of the forming block can apply the same operation as that of the virtual huge forming roll to the material to be formed and the various problems of the roll can be solved.

Further, the inventor et al. have a knowledge that the forming pass of the shoe forming the shoe block train is constructed by the circular curved surface formed in such a way that a generating curve including a part or all of a surface form of a target section turns round a central axis of the virtual circle or an axis located at a position near the central axis by a prescribed angle, so that the same effects, can be obtained, as those obtained by carrying out a forming operation by the use of the virtual huge forming roll.

The inventor et al. have a knowledge that when the above-described new forming apparatus is used in a process for sizing the material to, for instance, a target sectional form, the above-described peak of the local contact stress is greatly moderated in the material to be formed. Further, they recognize that since the material to be formed can be constrained by the pass part for a longer time than the conventional roll forming apparatus, a uniform plastic working process is applied to a longitudinal direction and a circumferential direction of the material to be formed to improve a roundness and a straightness. Further, the productivity is the same as that of the conventional roll forming, and the insertion resistance of the material to be formed is lower than that of the conventional roll forming and a required driving force is reduced and complete the present invention.

Therefore, the present invention is a forming apparatus and a forming method using the forming apparatus, the forming apparatus comprising: a shoe block train including a plurality of shoes whose cross-sectional shape at its outward surface includes a part or all of the peripheral shape of the target cross-section of the metal strip to be formed by the device; and one or several turning units, each of which having an endless track on which an aforesaid shoe block train moves, wherein the shoes come in contact with and moves synchronously with the metal strip to be formed in a forming area in the longitudinal direction of the strip, wherein the portion of the aforesaid endless track in the aforesaid forming area is an arc having a required length and a radius of a virtual circle. The forming apparatus and the forming method is characterized in that a part of a face of the endless track in the forming area has a required length of arc and a radius of a virtual circle.

Further, the inventor et al. provide a forming apparatus and a forming method characterized in features directed below, in the above mentioned the forming apparatus and the forming;

(a) The shoe block train is an endless train.

(b) The adjacent shoe blocks in the aforesaid forming area contact with each other so that their outward surfaces are connected to be continuous die surface to form the strip.

(c) The outward surface of the shoe has a curved surface formed by revolving a generating curve including a part or all of the peripheral shape of the target cross-section of the metal strip to be formed around an axis.

(d) The outward surface of the shoe has a curved surface formed by revolving a mother curve including a part or all of the peripheral shape of the target cross-section of the metal strip to be formed around an axis that is the central axis of the aforesaid virtual circle.

(e) The turning units are disposed parallel to the metal strip to be formed or opposite to each other around the strip.

(f) Besides the turning unit, one or several forming rolls, or one or several shoes, or both of them come in contact with the metal strip in the aforesaid forming area of the forming apparatus.

(g) The outer surface of the endless track in the turning unit forms an inner track, inner surface of the endless shoe block train forms an outer track, and rolling elements such as balls or rollers are integrated between the above inner and outer tracks so as to form a ball or roller bearing structure.

Further, the present invention is a shoe for the forming apparatus having the above configurations, the outward surface of the shoe has a curved surface formed by revolving a mother curve including a part or all of the peripheral shape of the target cross-section of the metal strip to be formed around an axis.

Advantageous Effects of Invention

In the present invention, since the forming apparatus is employed with a structure using a turning unit formed with an endless shoe block train that is formed by connecting together many shoes each having die with circular curved surfaces so as to be continuously movable on an endless track with the pass directed outward, and the same radius of curvature and the same length as those of a prescribed circular arc part of a virtual circle having an assumed huge diameter are given to an endless track surface of a forming block which abuts on the material to be formed to realize, so to speak, the use of a forming roll having the huge diameter, a continuity and a high productivity which are features of the conventional forming roll are maintained and the material to be formed can be two-dimensionally deformed substantially in the same way as that of the press forming.

Since the forming apparatus and the forming method according to the present invention have the above-described structure, the forming apparatus and the forming method exhibit following operational effects. (1) An additional distortion due to the three-dimensional deformation applied to the material to be formed is suppressed to a small value as low as possible, and a distribution of the residual stress is uniform. (2) A relative slip due to a peripheral speed difference between a forming tool and the material to be formed hardly occurs. (3) Since a contact area is wide and the occurrence of the peak of the contact stress when the material to be formed advances is suppressed, a bearing pressure is exceptionally lowered. (4) A traveling resistance is greatly reduced and the driving energy is greatly reduced.

Accordingly, the forming apparatus and the forming method according to the present invention can drastically improve the above-described disadvantages in the conventional roll forming and exhibit following operational effects. (1) The dimensional accuracy, the surface quality and the intrinsic quality of the product are greatly improved. (2) Ranges of forming (a ratio of thickness to outside diameter or a formable material) are enhanced. (3) A cost of the forming tool is reduced and the life of the forming tool is greatly extended. (4) An energy-saving product can be manufactured.

DESCRIPTION OF EMBODIMENTS

Figure 1A:
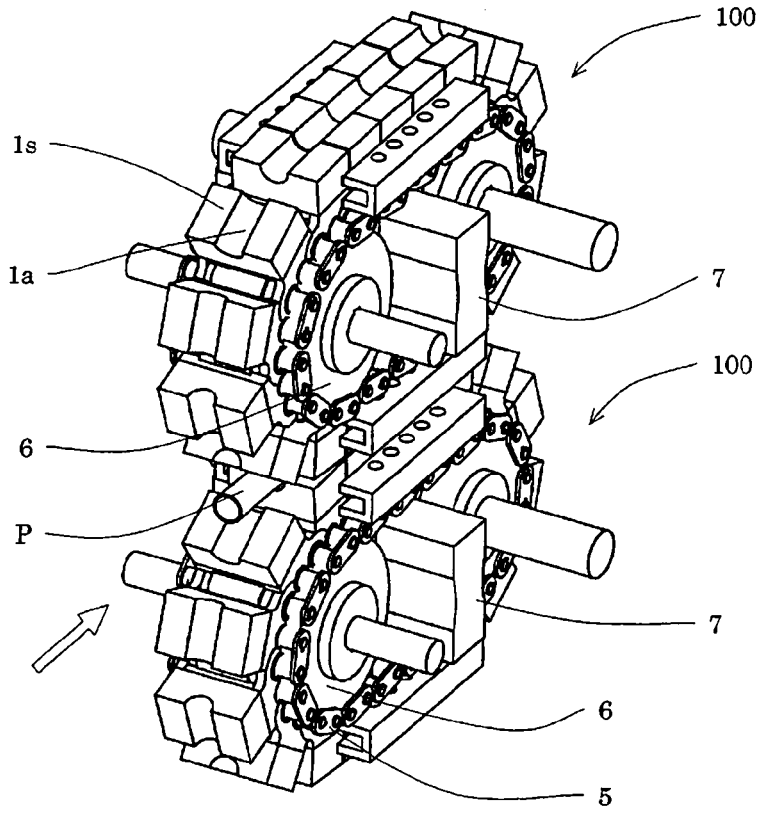
FIG. 1A is a explanatory oblique view showing an embodiment of the forming apparatus, in a configuration fixing a material pipe to be formed from upward and downward, viewed in a procession direction of the material pipe from front to back of the view.
Figure 1B:
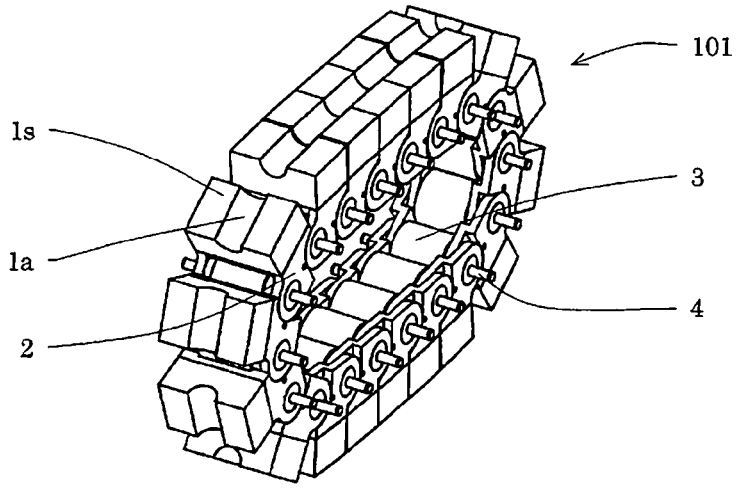
FIG. 1B is a explanatory oblique view of an endless shoe block train of the forming apparatus.
Figure 1C:
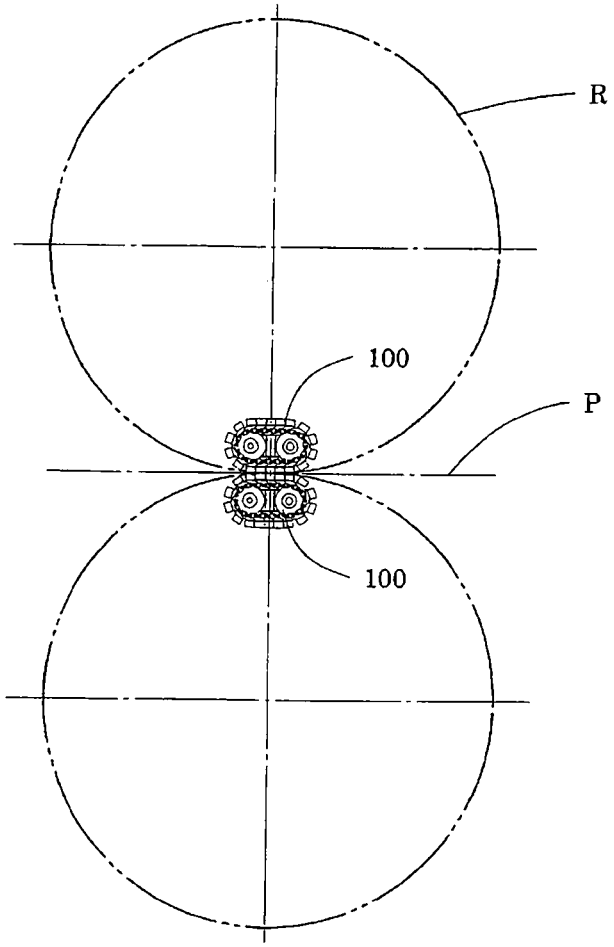
FIG. 1C is a conceptual explanatory view showing a relation between the forming apparatus shown in FIG. 1A and virtual huge forming rolls.
Figure 1D:
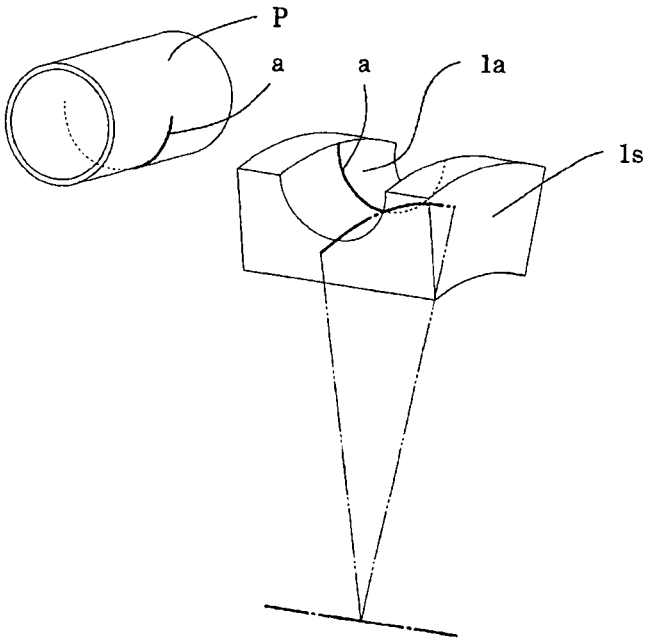
FIG. 1D is a conceptual explanatory view of a pass of a shoe.

A forming method according to the present invention will be described by referring to the drawings. FIGS. 1A and 1B are perspective explanatory views of a forming apparatus for sizing a material pipe to be formed. FIG. 1C is a conceptual explanatory view showing a relation between a virtual forming roll having a huge diameter and the forming apparatus shown in FIGS. 1A and 1B. FIG. 1D is a conceptual explanatory view of a forming pass of a shoe. In the drawing, a void arrow mark shows a forming direction, and this is applied to other drawing.

Now, a concept will be described below that embodies a forming apparatus in which the same operational effects as those obtained by using huge forming rolls can be obtained. As shown in FIG. 1C, it is a basic concept that only a circular arc part with a certain length of a virtual circle having a huge diameter is used which corresponds to an area where the huge virtual forming rolls R come into contact with the material pipe P to be formed. For instance, when a diameter of the material pipe P to be formed is 50 mm, if the virtual forming rolls R having a radius of 7000 mm are used, the length of the circular arc part of the virtual forming rolls that abut on the material pipe P to be formed is about 100 mm. In the drawing, for the convenience of a sheet surface, the circle is plotted with a radius much smaller than an assumed radius.

In order to realize the circular arc part as the contact area of about 100 mm in the virtual forming rolls R having the radius of 7000 mm, a pair of turning units 100 and 100 have structures in which endless shoe block trains 101 are formed by connecting together shoes 1*s* each having profile surface directed outward through jigs as shown in FIG. 1A and are turned and moved on endless tracks. As shown in FIG. 1B, a shoe holder 2 of the connecting jig has a saddle shape in which a mount surface of the shoe 1*s* is provided in an upper surface and holder connecting parts are provided with two pairs of front and back pin holes in both vertical side surface parts. The shoe holders 2 are arranged in the same direction to alternately attach the connecting parts thereto. A rolling roller follower 3 is arranged in the saddle form and a shaft end passing through and arranged from the pin hole is provided as a connecting pin 4.

Accordingly, in the endless shoe block train 101, the shoe holders 2 mounted on the roller followers 3 and having the shoes 1*s* mounted thereon are connected together by chain plates 5 to be configured to a chain and a sprocket 6 is engaged with the connecting pins 4 so that the endless shoe block train 101 may be rotated and driven. Here, the shoes 1*s* connected together by a group of the roller followers 3 which roll on an endless track surface can be continuously moved with prescribed forming passes 1*a* directed outward.

In a part corresponding to a forming block of a beam 7 that forms the endless track surface and supports the endless shoe block train 101, a plurality of shoes abut on mutually to be formed integrally with a rigidity. To the endless track surface of the forming block, a radius of curvature (7000 mm) of the above-described virtual forming roll R is given.

The turning units 100 and 100 composed of the endless shoe block trains 101 having the shoes 1*s* turning and moving on the endless tracks are arranged to be opposed as one pair at upper and lower parts, and prescribed circular curved surfaces are respectively set on the surfaces of the forming passes 1*a* of the shoes 1*s*, so that the forming apparatus used for a sizing process can be formed.

In other words, the technical idea of the present invention resides in that the virtual forming rolls R having the huge diameter are supposed to be used. For instance, the shoe 1*s* has the forming pass 1*a* corresponding to a target cross sectional form of the material pipe P to be formed. The plurality of shoes 1*s* are connected together to form the shoe block train 101. The turning unit 100 is formed so that the shoe block train may turn and move on the endless track. Further, an apparatus for forming a material to be formed is formed by arranging a single or a plurality of turning units 100. To the shoe block train passing the forming block, a moving locus of a circular arc having a huge radius is given, so that forming operational effects substantially the same as those of the virtual forming roll having the same huge radius can be achieved.

In this forming apparatus, not only the above-described endless shoe block train, but also shoe block trains having various structures can be suitably selected depending on a target cross sectional form of a material to be formed, such as a structure in which a plurality of shoe block trains are arranged at prescribed intervals and turn and move on a endless track.

Now, the forming pass of the shoe used in the forming apparatus will be described below in detail. In order to embody the forming pass of the huge virtual forming roll in the forming block, as shown in FIG. 1D, the forming profile 1*a* of the shoe 1*s* is formed by the circular curved surface formed in such a way that a generating curve "a" including a part or all of a surface form of a target form section of a product P turns round an axis of the virtual forming roll R by a prescribed angle. Thus, the forming pass of the huge virtual forming roll R is realized to exhibit the same forming operational effects as those of the huge virtual forming roll.

In the forming apparatus, under a condition that the length of the shoe in a forming direction (a circumferential direction of the virtual circle) is sufficiently smaller than the radius of the virtual circle, even when the forming passes of the shoes are not respectively formed with the above-described circular curved surfaces, the operational effects substantially the same as those of precisely circular curved surfaces can be obtained. Further, even when the central axis of the circular curved surface does not completely correspond to the central axis of the virtual circle, the effects substantially the same as those of the precisely circular curved surface can be obtained under the above-described condition.

In this forming method, it is to be understood that the target cross sectional form indicates a form obtained when a forming operation is completed in one forming apparatus. However, in a design of a pass of the conventional forming roll, the form of the pass and a target sectional form are occasionally daringly set to be different from each other so that a dimension of a product after the roll passes a forming block may come near to a target dimension. Namely, an elastic recovery quantity is supposed to bend a material to be formed more than the target dimension and return the material to be formed to a prescribed form after the roll passes the forming block. Also in the present invention, the form of the pass slightly different from the target sectional form is occasionally set.

In this forming method, reasons that a locus of the forming block is not linear, limited and has a proper radius of curvature are described below.

Figure 1E:
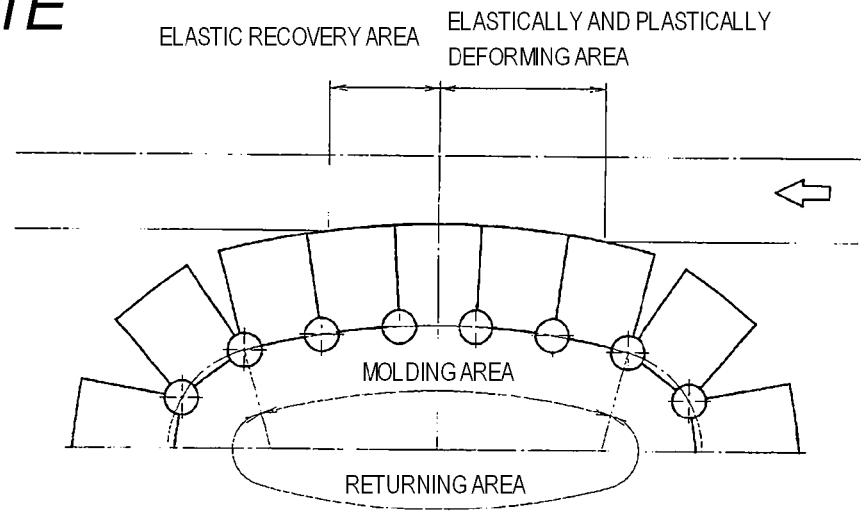
FIG. 1E is a conceptual explanatory view showing a relation between the shoe in a forming area and an endless track surface thereof.

As shown in FIG. 1E, in an elastically and plastically deforming area of the first half of the forming section, since the shoes continuously press down to deform the surface of the material to be formed, the endless track of that part needs to be inclined toward a lowermost point of a pressing-down operation of the shoes from an entrance side of the forming block. On the other hand, as a feature of a metallic deformation movement, since a shape change of the material to be formed necessarily occurs following an elastic recovery in a process for removing a load, in an elastic recovery area of the latter half of the forming block, the endless track needs to be inclined toward an exit side of the forming block from the lowermost point of the pressing-down operation of the shoes in an opposite direction to that of the first half of the forming block in order to elastically recover the material to be formed and smoothly separate the material to be formed from the shoes. Further, in all the area of the forming block, continuous surfaces of the forming passes need to be formed. Accordingly, the locus of the endless track that satisfies all the above-described conditions is not a straight line, but a circular arc.

As compared therewith, the device using the conventional shoe train does not carry out a forming operation as in the forming method of the present invention, as described in the PTL 3 and PTL 4 of the related art, and has a function as a simple guide or a function like a traction device for the purpose of a thrust. In an area where the device abuts on a material, the device merely embraces the material without supposing a large deformation. Even when the locus of an endless track is set to a straight line, a problem does not arise.

In the present invention, when the forming apparatus is applied to a production of a round pipe, a relation between a target diameter of the material pipe to be formed and the diameter of the virtual forming roll is described below. In order to cancel a local concentrated load in an area where the conventional forming roll comes into contact with the material to be formed, when the diameter of the virtual forming roll is larger, it may be said to be the more preferable. However, when the diameter of the roll is larger, a load applied to the device is the more increased. There is a saturation point of an effect due to the enlarging of the diameter of the virtual forming roll depending on the kinds of objects to be formed or forming processes. The diameter of the virtual forming roll needs to be suitably selected by collectively considering the above-described matters. This may be applied to even a case that a product has an open profile.

In the present invention, as for the shape of the endless track of the forming apparatus, the circular arc part having the same curvature as that of the virtual forming roll with the huge diameter may be formed only on the endless track surface of the forming block, and other part is a regression block which may have a shape for merely returning the shoes and any of known shapes may be used.

As a mechanism for turning and moving the shoe block train along the endless track surface, a known sliding mechanism or a rolling mechanism as, what is called a bearing may be used. For instance, well-known mechanical mechanisms can be suitably selected such as a structure in which a sliding material having a low coefficient of friction is mounted on an outer surface of a endless track or an inner surface of a shoe holder to slide and move the sliding material, a structure in which a roller follower type or cam follower type bearing is incorporated as shown in FIGS. 1A and 1B and a structure in which an inner surface of a shoe holder is formed as an outer race, a endless track surface is formed as an inner race, a rolling member such as a ball train or a roller train or a train of the combination thereof is sandwiched between both the races as shown in a first exemplary embodiment and at least the forming block of the endless track is formed as a bearing.

In the present invention, the forming apparatus may be used in any of processes for manufacturing the round pipe. For instance, the forming apparatus may be applied to an edge bending process of a break down process. A structure in which conventional upper and lower rolls are changed to a pair of turning units of the present invention or a structure in which the conventional forming roll is arranged in an upper side and the turning unit is arranged in a lower side may be used. Further, in various processes such as clustering, a fin pass, butt welding, sizing or the like, the turning unit may be suitably employed in place of the conventional forming roll.

Namely, in the present invention, in accordance with the target cross sectional form or the stage of forming of the material to be formed, the turning units may be arranged in parallel or opposed to each other, and the forming roll or other metal die such as the shoe may be combined with each of the turning units as a mate.

FIRST EMBODIMENT

Figure 2A:
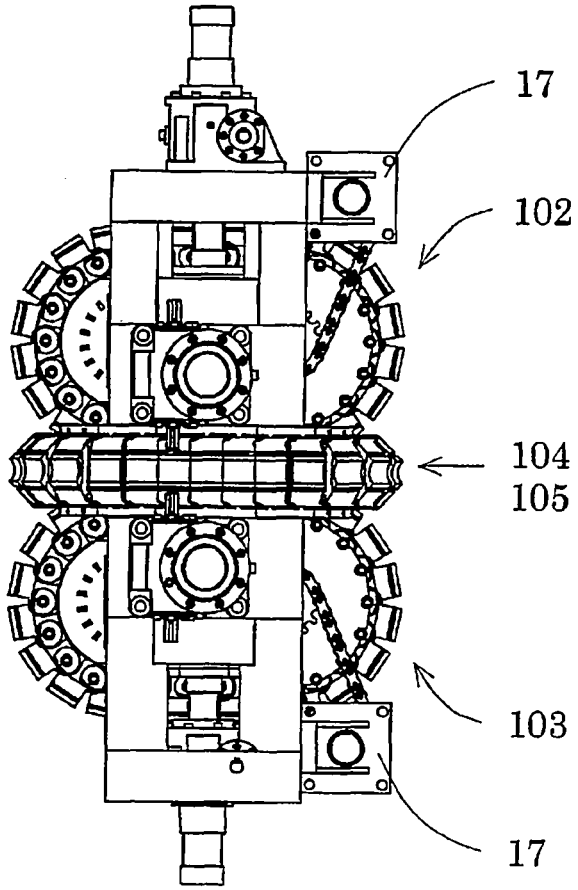
FIG. 2A is a side view showing an embodiment of the forming apparatus, in a configuration fixing the material pipe to be formed from upward, downward, leftward and rightward, view in the procession direction of the material pipe from right to left of the view.
Figure 2B:
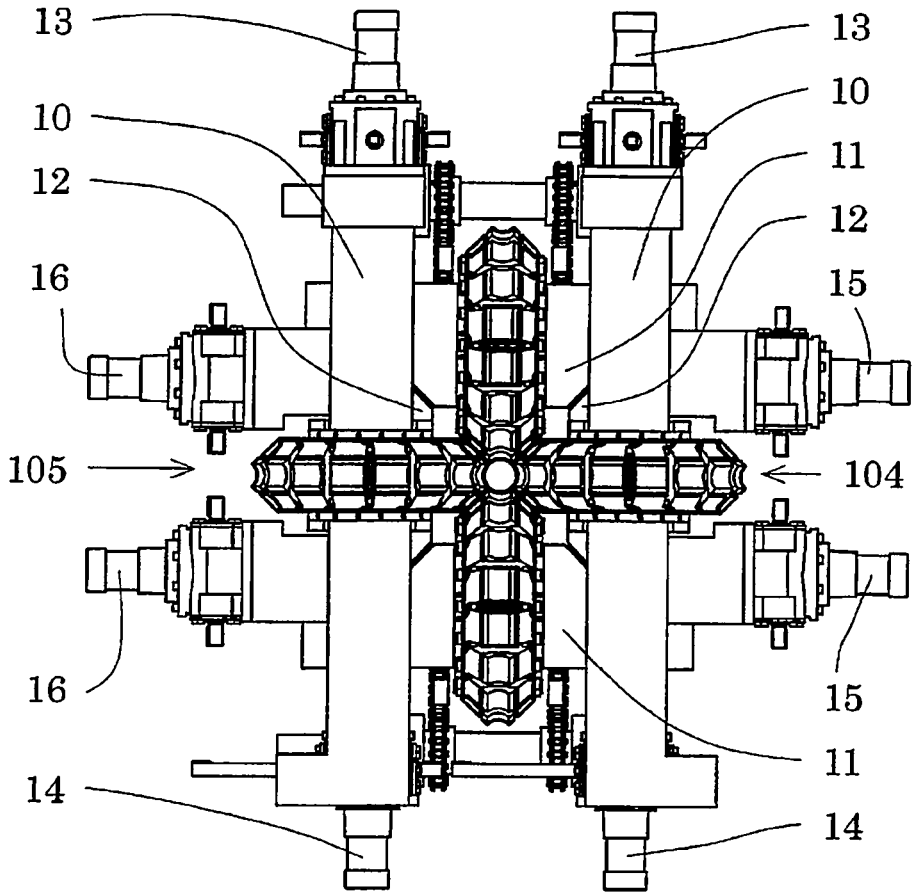
FIG. 2B is a front view showing the embodiment of the forming apparatus, in the configuration fixing the material pipe to be formed from upward, downward, leftward and rightward, view from the procession direction.

A forming apparatus shown in FIGS. 2A and 2B has a structure that binds a material pipe 2 to be formed from four directions to size the material to be formed. One pairs of endless shoe block trains 102, 103, 104 and 105 which are opposed and arranged in a vertical direction and a horizontal direction are respectively supported by beams 11, 11, 12 and 12. The beams 11, 11, 12 and 12 are supported by housings 10 and 10 through jacks 13, 14, 15 and 16 for adjusting their supporting positions.

Figure 3:
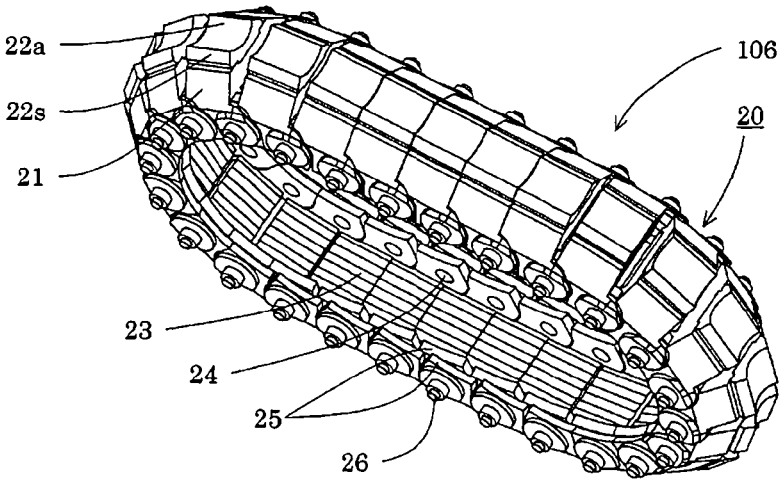
FIG. 3 is a explanatory oblique view showing an embodiment of an endless shoe block train.
Figure 6:
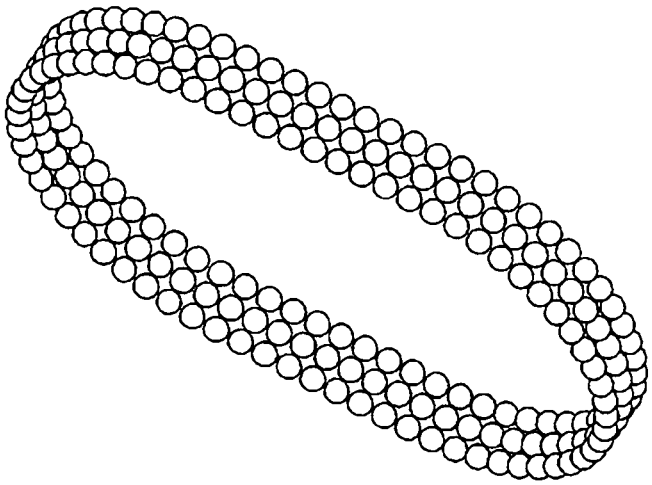
FIG. 6 is an explanatory oblique view showing a configuration of a ball train disposed on a groove part on the endless track surface for causing the endless shoe block train to turn freely.

The endless shoe block trains 102, 103, 104 and 105 are respectively made to be endless by connecting a shoe assembly 20 shown in FIG. 3 by pins 26 and formed so as to freely turn by inserting three ball trains shown in FIG. 6 between the endless shoe block trains and endless track surfaces supported by the beams 11, 11, 12 and 12 to form ball bearing parts. Driving shaft units 17 and 17 drive turning units composed of the endless shoe block trains 102 and 103 opposed and arranged in the vertical direction of the four directions.

In the shoe assembly 20, on an upper surface part of what is called a saddle type shoe holder 21, a shoe (a metal die) 22*s* having a prescribed shape of a pass 22*a* is mounted and fixed. To an inner surface part, an outer race piece 23 is fixed. The holder 21 has holder connecting parts 25 and 25 provided with pin holes 24 in both vertical side surfaces thereof. Two pairs of front and back holder connecting parts 25 and 25 are alternately overlapped on and attached to the other and the pins 26 are fitted to the pin holes 24 to connect the holder connecting parts together.

Figure 4:
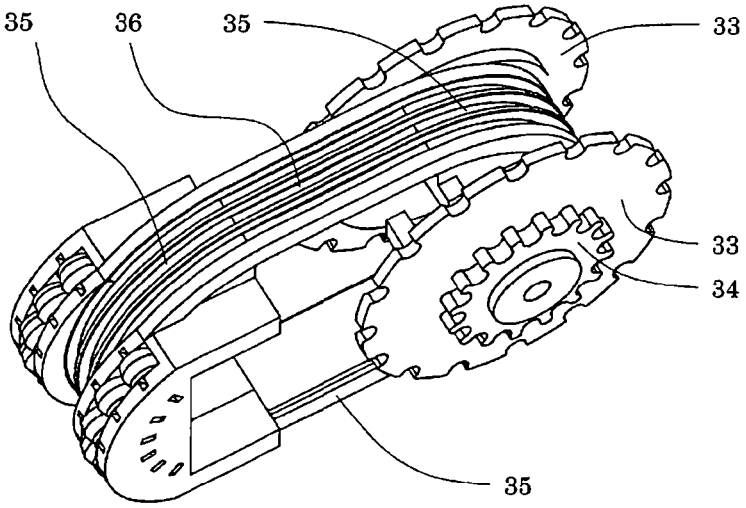
FIG. 4 is a explanatory oblique view showing an assembly configuration of an endless track surface of upper and lower driving units on which the endless shoe block train is turned.

As shown in FIG. 4, an endless track surface 36 corresponding to a endless track surface of a forming block of the races of the above-described balls has a curvature and a length for obtaining a forming effect of a virtual huge forming roll. The race of the balls is formed by endless track surfaces 35, 35 and 35 and a substantially flat endless track surface 36.

Further, driving sprockets 33 and 33 shown in FIG. 4 are engaged with pins 27 for connecting the shoe assembly 20 forming an endless shoe block train 106 so that a driving part may be formed. In the sprockets 33, and 33, sprockets having small diameters are coaxially arranged and a power from an electric motor can be transmitted through a driving shaft unit and a chain shown in FIGS. 2A and 2B. A gear driving may be easily realized in place of a chain driving.

Figure 5:
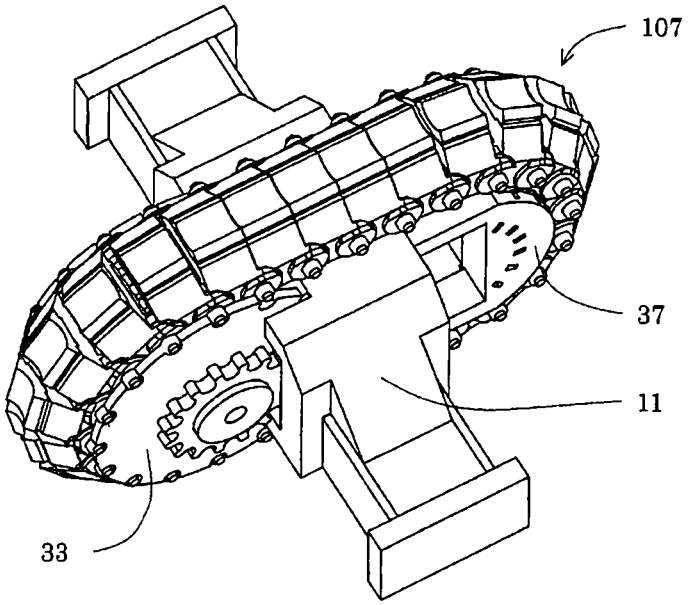
FIG. 5 is a p explanatory oblique view of a beam for supporting the assembly configuration of the endless track surface of the upper and lower driving units on which the endless shoe block train is turned.

The beam for supporting the endless shoe block train and a orbital surface part assembly is described below. FIG. 5 shows a state that the beam 11 is passed through and attached to the endless track surface part assembly shown in FIG. 4 and the endless shoe block train 103 is externally attached.

Here, the material pipe is bound by the shoe block trains of the turning units in the four directions, undergoes a prescribed forming process, and is sized so as to have an outside diameter located within a target tolerance. In this forming apparatus, a sizing stand having three to four stages by a usual four-way roll can be completed in a one-stage structure having the above-described dimension shown in FIG. 2. Further, since an area where the material pipe comes into contact with the forming apparatus has a long distance in the longitudinal direction, the material pipe receives innumerable three-point bending while the material pipe passes the forming block to become a straight pipe and also has a function of a Turk-head stand for removing a warp or a bending.

An entire dimension of the forming apparatus of the present exemplary embodiment shown in FIGS. 2 to 6 will be described below. When a maximum diameter of a product is 50 mm, in an external dimension of the endless shoe block trains 102, 103, 104 and 105 in which the endless track surface part assemblies are incorporated, length×height×width is about 800 mm×500 mm×140 mm. An external dimension of all the device including the housings 10 and 10 in which the beams are incorporated is similarly about 1,100 mm×1,800 mm×1,000 mm. Thus, as compared with a diameter of 14,000 mm of an assumed virtual forming roll, an extremely compact device can be realized.

SECOND EMBODIMENT

A forming apparatus having the same structure as that of the first embodiment is applied to a sizing process of a product having a target diameter of 100 mm and a thickness of 7 mm. A material is hot-rolled steel and a reduction rate is 1%.

To a forming block of an endless track of the forming apparatus, radii of curvature (2,500 to 20,000 mm) are applied to study a contact state of an endless shoe block train and a material to be formed and a load distribution. Further, as objects to be compared, a sizing device having a conventional four-way roll (a radius of 200 mm) and a device having the same structure as that of this embodiment and a linear forming block are prepared.

Figure 12:
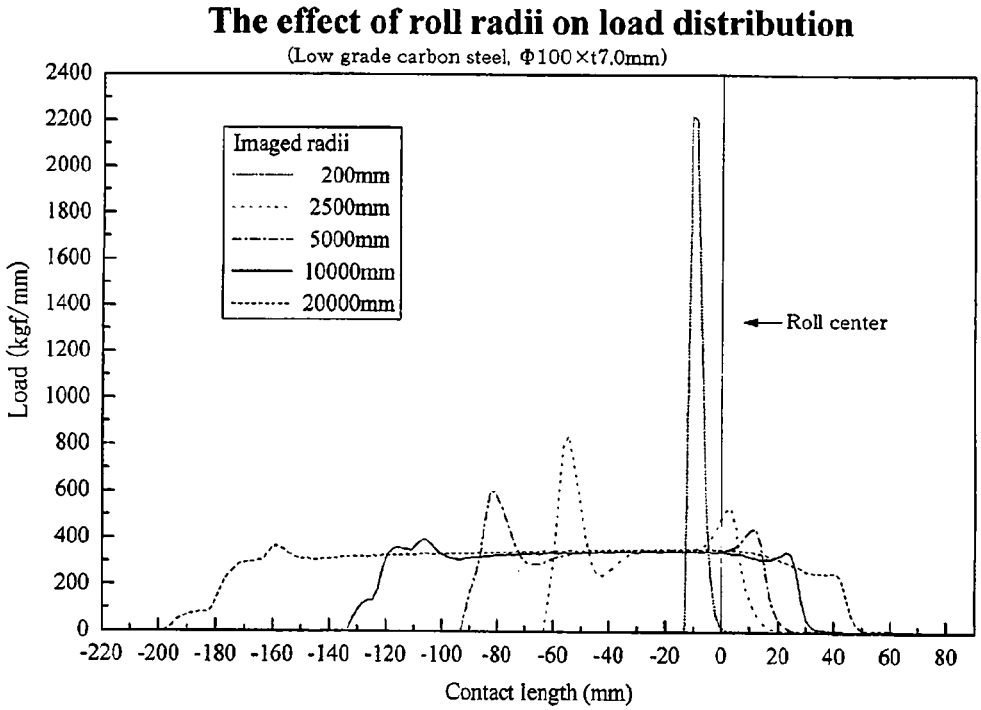
FIG. 12 is a graph showing a contact state and a load distribution acting on the material pipe to be formed.

FIG. 12 shows the contact state and the load distribution acting on a material pipe to be formed. An axis of abscissas of this graph indicates a longitudinal distance from a lowermost point (immediately below a roll) of a pressing down operation of a shoe of a turning unit. An axis of ordinates indicates a load (linear pressure) which sections of the material pipe respectively receive. As apparent from the drawing, when the roll having the radius of 200 mm is used, the load is concentrated to a certain position immediately before a part just below the roll and a contact length is extremely small. As compared therewith, in the device of this exemplary embodiment, a forming load is extremely distributed. However, it can be understood that when the radius of the virtual roll is larger, such an effect is saturated.

On the other hand, when a comparative device having the linear forming block is used, the occurrence of contact flaws and a discontinuous dimensional change of the material pipe appear in a connecting part of the forming block and a regression block, so that a prescribed forming operation cannot be carried out.

THIRD EMBODIMENT

In the second embodiment, when a material of a material pipe to be formed is changed from ordinary steel to stainless steel to carry out a sizing process, in the case of a conventional roll forming, the occurrence of seizure on the surface of the material pipe due to a relative slip of the material pipe and the forming roll is detected under a non-lubrication. As compared therewith, in the forming apparatus of this embodiment, a seizure does not occur even under the non-lubrication.

FOURTH EMBODIMENT

Figure 7:
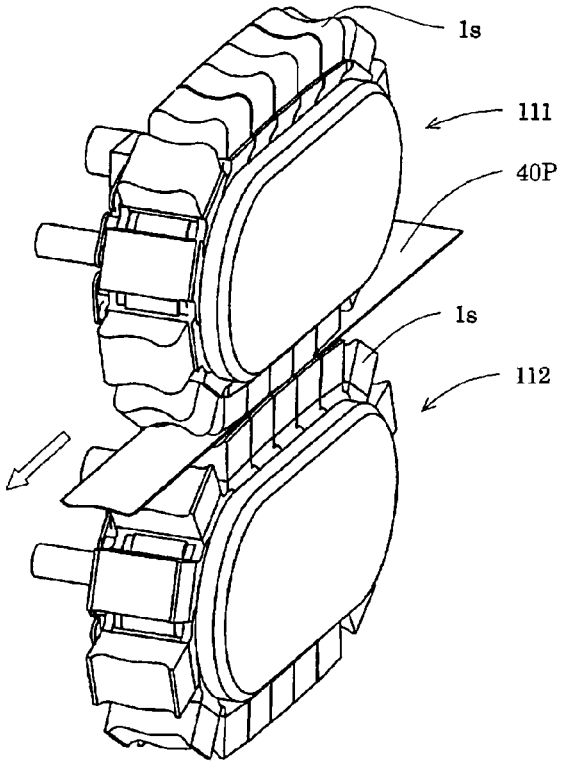
FIG. 7 is an explanatory oblique view of the forming apparatus which is applied to a bending process of an edge of a strip material.

FIG. 7 is an explanatory oblique view of a forming apparatus applied to a break down forming process. The forming apparatus is substituted for a pair of conventional upper and lower forming rolls to bend edges of a strip material 40P. A pair of upper and lower endless shoe block trains 111 and 112 have the same structure as that shown in FIG. 3. A forming profile 1*a* of each shoe 1*s* has a width corresponding to that of the strip material 40P. To a forming block in which the shoes 1*s* abut on the strip material 40P to move synchronously with the strip material 40P, a radius of curvature and a prescribed length of a virtual circle having a diameter 100 times as large as that of the usual forming roll are applied.

The shoes 1*s* and 1*s* of the endless shoe block trains 111 and 112 respectively sandwich the strip material 40P between an upper and lower parts. Each forming pass has a circular curved surface formed in such a way that a generating curve including substantially all of a surface shape of a target cross section turns round a central axis of the virtual circle by an angle corresponding to the prescribed length.

When a forming operation by the shoes in the forming block is compared with a forming operation by the conventional forming roll, since the forming operation by the shoes is the same as, so to speak, a press forming, a phenomenon that a large distortion is applied to the strip material 40P due to a winding of the strip material on the roll, which has been hitherto unavoidable, is substantially cancelled and a warp after the forming operation is hardly recognized.

FIFTH EMBODIMENT

Figure 8:
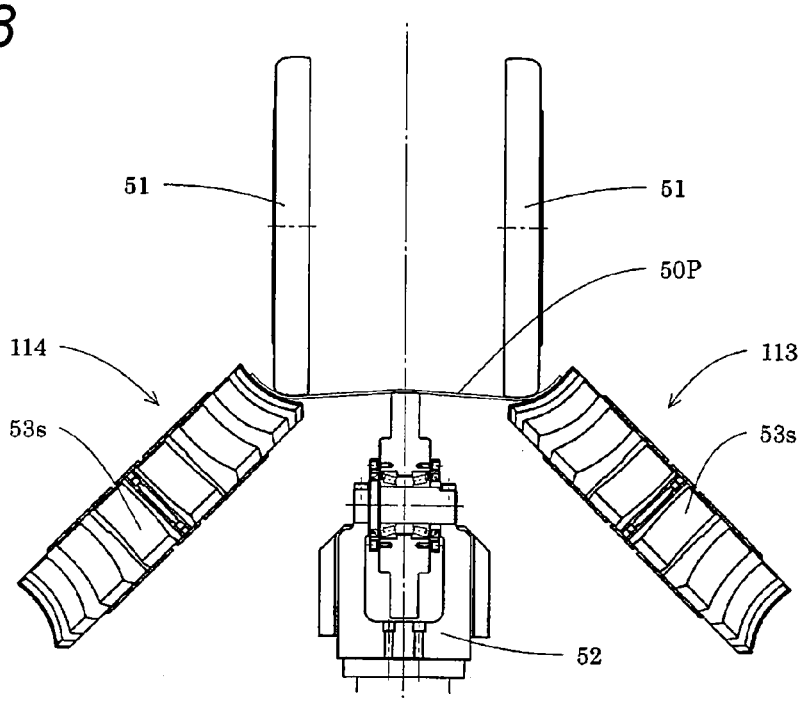
FIG. 8 is an explanatory oblique view of the forming apparatus which is applied to brake down forming process after the bending process of the edge of the strip material is finished.

A break down forming operation shown in FIG. 8 is carried out for the purpose of bending an adjacent part to an edge part of a strip material after the edge part of the strip material is completely bent in a pre-stage. As compared with a conventional device for forming by upper and lower forming rolls, turning units by endless shoe block trains 113 and 114 are used in place of a lower roll, so that the strip material 50P formed in the pre-stage is extremely smoothly introduced and bitten, and the edge part of the strip material 50P can be supported in a wide range of a forming direction by the turning units. Further, since upper rolls 51 and 51 supply inputs to an adjacent part to be formed under holding the formed part in the pre-stage, it can be recognized that an accurate and sufficient forming operation is carried out.

Especially, when a thin material is formed by using the conventional roll, the edge parts may be extended in a longitudinal direction larger than that of other part, so that a buckling (edge wave) phenomenon is liable to occur. However, in this exemplary embodiment, it can be recognized that winding or spring back is suppressed to hardly generate the buckling phenomenon and realize the break down forming operation of a high quality.

SIXTH EMBODIMENT

Figure 9:
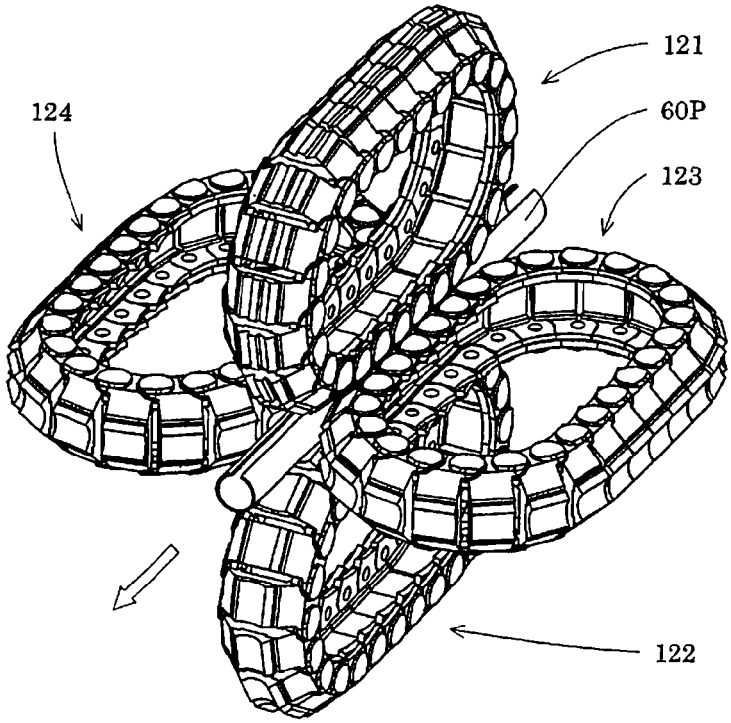
FIG. 9 is an explanatory oblique view of the forming apparatus used for a fin pass forming process.

FIG. 9 shows endless shoe block trains in four directions which are applied to a fin pass forming apparatus. The endless shoe block trains 121, 122, 123 and 124 in the four directions and turning units composed of other parts not shown in the drawing basically have the same structure as that shown in FIGS. 2A and 2B.

A forming pass of a shoe of any of the shoe block trains uses a circular curved surface formed in such a way that a generating curve including a part of a surface form of a target cross section turns round a central axis of a virtual circle having a prescribed huge diameter by an angle corresponding to a prescribed length. The generating curve of the forming pass of each shoe of the endless shoe block trains 122, 123 and 124 at both sides and a lower side is circular arc shaped. The shoe of the endless shoe block train 121 in an upper side has, what is called a fin shape abutting on opposed edges.

In a conventional forming apparatus by fin pass rolls, roll forming processes of two to four stages are necessary. However, in the fin pass forming apparatus of this embodiment, a forming function by a forming roll having the huge diameter can be obtained, so that only one stage can carry out a forming operation equal to that of the conventional forming apparatus. Since the edge part of a material to be formed is bound with a large length in the longitudinal direction, the torsion of the material is highly effectively suppressed.

SEVENTH EMBODIMENT

Figure 10:
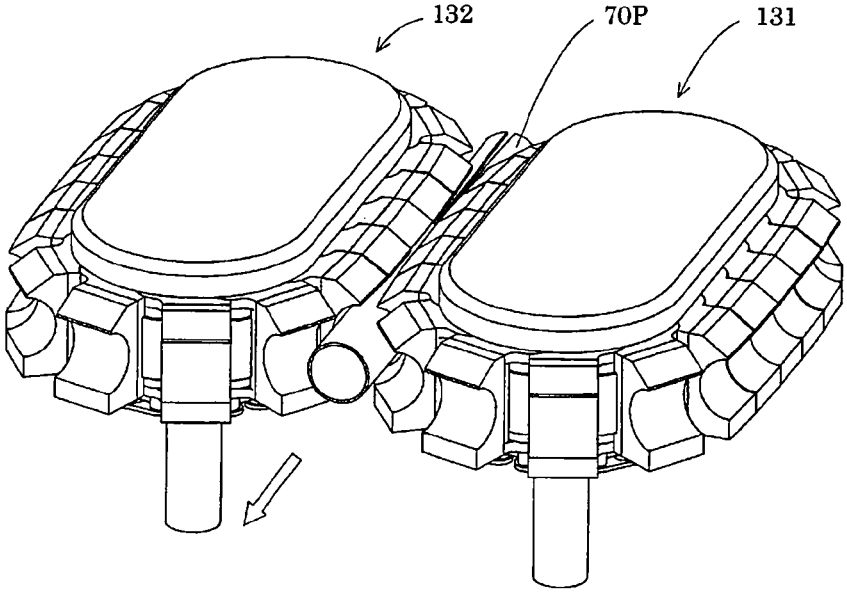
FIG. 10 is an explanatory oblique view of the forming apparatus used for a butting welding process in place of a squeeze roll.

A forming apparatus shown in FIG. 10 is substituted for a squeeze roll interlocking with a TIG or a laser welding device.

Turning units composed of endless shoe block trains 131 and 132 at both sides and other mechanisms not shown in the drawing basically have the same structure as that shown in FIGS. 1A and 1B. Further, a block in which a material pipe 70P comes into contact with the shoe block trains and a pass of a shoe use the same structures as those of the forming block and the forming pass in other embodiments.

A butt welding by the device of this embodiment has an advantage that a binding time of a material by the shoe block trains and a distance of the material bound by the shoe block trains are much longer than those of the usual squeeze roll. Further, as compared with a usual simple guide or a endless track type for applying a thrust, a good butt welded state of edge parts can be formed by a forming function of a forming roll having a huge diameter and held for a sufficient time to easily optimize and stabilize a welding condition.

EIGHTH EMBODIMENT

Figure 11:
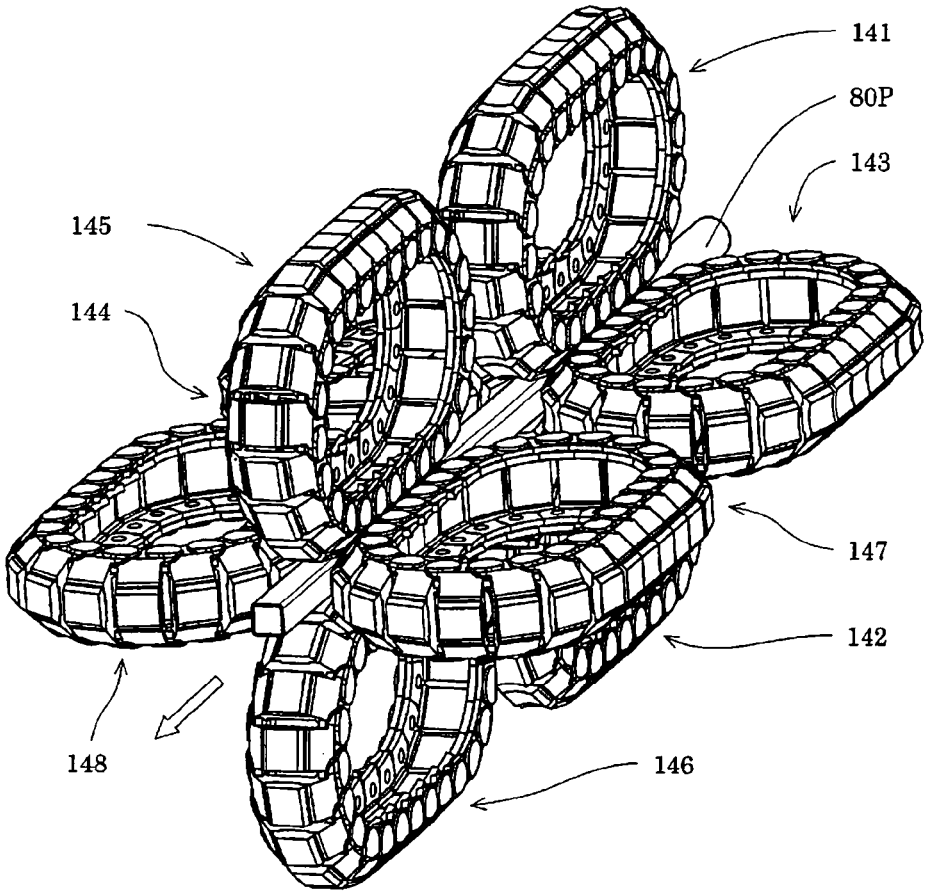
FIG. 11 is an explanatory oblique view of a reforming apparatus of a rectangular pipe in which a round pipe is used for the material pipe.

A round pipe 80P cut to a prescribe length is reformed into a rectangular pipe by a forming apparatus of the present invention which has a two-stage structure as shown in FIG. 11. A first stage stand having turning units of four directions composed of endless shoe block trains 141, 142, 143 and 144 and a second stage stand having turning units of four directions composed of endless shoe block trains 145, 146, 147 and 148 respectively basically have the same structure as that of the first embodiment shown in FIGS. 2A and 2B.

In a conventional forming roll, when the round pipe is introduced into a roll forming machine, a phenomenon arises that an end of the pipe is bent inward so as to be closed. Thus, a problem arises that a product greatly deviates from a tolerance of product. Since the end of the round pipe is lower in its rigidity than a central part of the pipe and a radius of curvature in the longitudinal direction of the forming roll is applied to the round pipe when the round pipe abuts on the forming roll, the above-described phenomenon occurs. As compared therewith, since the forming apparatus of the present exemplary embodiment has an extremely preferable guiding property of a material pipe like the use of a virtual huge forming roll, the above-described problem does not arise.

In the reforming operation, a large amount of variation appears in a cross sectional shape and a high traveling resistance is generated in the forming roll to hardly ensure a thrust force. In the forming apparatus of the present exemplary embodiment, not only the traveling resistance is reduced, but also a sufficient thrust force is applied to the material pipe by driving the turning units. Therefore, a usual rectangular pipe forming apparatus requires many driving roll stands, however, the forming apparatus of this embodiment can be realized only by the above-described two stage structure.

INDUSTRIAL APPLICABILITY

The forming apparatus and the forming method according to the present invention are high in their forming capability as apparent from the embodiments and can exceptionally improve the dimensional accuracy, the surface quality and the intrinsic quality of a product.

Further, the forming apparatus and the forming method according to the present invention can maintain the same productivity as that of a usual forming roll, enlarge the limit of forming by the forming roll, change a manufacturing system and simplify the structure of the device of a forming line.

REFERENCE SIGNS LIST a generating curve
P material pipe to be formed
R virtual forming roll
1*s* shoe
1*a* profile
2 shoe holder
3 roller follower
4 connecting pin
5 chain plate
6 sprocket
7 beam
10 housing
11, 12 beam
13 to 16 jack
17 driving shaft unit
20 shoe assembly
21 shoe holder
22*s*, 53*s* shoe
22*a* profile
23 outer race piece
24 pin hole
25 holder connecting part
26 pin
33, 34 sprocket
35 endless track surface of ball in returning area
36 endless track surface of ball in forming area
40P, 50P material strip
60P, 70P, 80P material pipe
51 upper roll
52 central lower roll
100 turning unit
101 to 107, 111 to 114, 121 to 124, 131 to 132, 141 to 148 endless shoe block train

The invention claimed is:

1. A forming apparatus, comprising:

a shoe block train including a plurality of shoes, each of the shoes being formed with a concave die, and a cross-sectional shape of the concave die, in a longitudinal direction of a material to be formed, at its outward surface being an arc having a radius of a first virtual circle so that the cross-sectional shape extends along a part or all of the peripheral shape of the target cross-section of the material to be formed by the apparatus; and at least one turning unit, each of which having an endless track on which the shoe block train moves, wherein the shoes come in contact with and move synchronously with the material in a forming area during movement in the longitudinal direction of the material, and wherein a portion of the endless track in the forming area defines an arc having a radius of a second virtual circle having a center of curvature identical to a center of curvature of the first virtual circle.

2. A forming apparatus as set forth in claim 1, wherein the shoe block train is an endless train.

3. A forming apparatus as set forth in claim 1, wherein the adjacent shoe blocks in the forming area contact with each other so that their outward surfaces form a continuous die surface to form the material.

4. A forming apparatus as set forth in claim 1, wherein the outward surface of the concave die has a curved surface defined by revolving a generatrix including a part or all of the peripheral shape of the target cross-section of the material around a central axis of the first virtual circle.

5. A forming apparatus as set forth in claim 1, wherein the turning units are disposed parallel to the material or opposite to each other around the material.

6. A forming apparatus as set forth in claim 1, further comprising one or a plurality of forming rolls, wherein at least one forming roll, or at least one shoe, or both of them come in contact with the material in the forming area of the forming apparatus.

7. A forming apparatus as set forth in claim 1, wherein an outer surface of the endless track of the turning unit forms an inner track, an inner surface of the shoe block train forms an outer track, and rolling elements are integrated between the inner and the outer tracks so as to form a rolling bearing structure.

8. A shoe for a forming apparatus, the shoe comprising:

a concave die having an outward surface configured to contact a material to be formed, wherein a cross-sectional shape of the concave die at the outward surface viewed from a moving direction of the shoe corresponds to a part or all of a peripheral shape of a target cross-section of a material to be formed, wherein the moving direction is a direction in which the shoe is moved in use, and the outward surface of the concave die has a curved surface of revolution around an axis which is orthogonal to the moving direction, and a generatrix of the curved surface of revolution includes a part or all of the peripheral shape of the target cross-section of the material.

9. A forming method by adopting a forming apparatus, the method comprising:

introducing a material to be formed in a forming area on a shoe block train;

deforming the material in the forming area by a plurality of shoes of the block train;

wherein the apparatus comprising:

the plurality of shoes, each of the shoes being formed with a concave die, and a cross-sectional shape of the concave die in a longitudinal direction of the material at its outward surface being an arc having a radius of a first virtual circle so that the cross-sectional shape extends along a part or all of the peripheral shape of the target cross-section of the material to be formed by the apparatus; and at least one turning unit, each of which having an endless track on which the shoe block train moves, wherein the shoes come in contact with and moves synchronously with the material in a forming area during movement in the longitudinal direction of the material during the deforming step, and wherein a portion of the endless track in the forming area defines an arc having a radius of a second virtual circle having a center of curvature identical to a center of curvature of the first virtual circle.

10. A forming method as set forth in claim 9, wherein the shoe block train is an endless train.

11. A forming method as set forth in claim 9, wherein the adjacent shoe blocks in the forming area contact with each other so that their outward surfaces form a continuous die surface to form the material.

12. A forming method as set forth in claim 9, wherein the outward surface of the shoe has a curved surface formed by revolving a generatrix including a part or all of the peripheral shape of the target cross-section of the material around an axis.

13. A forming method as set forth in claim 9, wherein the turning units are disposed parallel to the material or opposite to each other around the material.

14. A forming method as set forth in claim 9, wherein, at least one forming roll, at least one shoe, or both of them come in contact with the material in the forming area of the forming apparatus.

15. A forming method as set forth in claim 9, wherein an outer surface of the endless track of the turning unit forms an inner track, an inner surface of the shoe block train forms an outer track, and rolling elements are integrated between the inner and the outer tracks so as to form a rolling bearing structure.

* * * * *